US011371302B2

(12) United States Patent
Teodorescu et al.

(10) Patent No.: US 11,371,302 B2
(45) Date of Patent: Jun. 28, 2022

(54) REAL TIME DRILLING FLUID RHEOLOGY MODIFICATION TO HELP MANAGE AND MINIMINZE DRILL STRING VIBRATIONS

(71) Applicant: HALLIBURTON ENERGY SERVICES, INC., Houston, TX (US)

(72) Inventors: Sorin G. Teodorescu, The Woodlands, TX (US); Dale E. Jamison, Humble, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 252 days.

(21) Appl. No.: 15/525,544

(22) PCT Filed: Dec. 18, 2014

(86) PCT No.: PCT/US2014/071023

§ 371 (c)(1),
(2) Date: May 9, 2017

(87) PCT Pub. No.: WO2016/099498

PCT Pub. Date: Jun. 23, 2016

(65) Prior Publication Data

US 2018/0023355 A1 Jan. 25, 2018

(51) Int. Cl.

| | |
|---|---|
| ***E21B 21/06*** | (2006.01) |
| ***E21B 44/00*** | (2006.01) |
| ***E21B 47/00*** | (2012.01) |
| ***E21B 47/022*** | (2012.01) |
| ***E21B 21/08*** | (2006.01) |

(52) U.S. Cl.

CPC ..... *E21B 21/06* (2013.01); *E21B 21/08* (2013.01); *E21B 44/00* (2013.01); *E21B 47/00* (2013.01); *E21B 47/022* (2013.01)

(58) Field of Classification Search

CPC ..... E21B 21/06; E21B 47/022; E21B 47/00; E21B 44/00; E21B 21/08

See application file for complete search history.

(56) References Cited

U.S. PATENT DOCUMENTS

| | | | |
|---|---|---|---|
| 6,408,953 | B1 | 6/2002 | Goldman et al. |
| 7,036,612 | B1 | 5/2006 | Raymond et al. |
| 8,589,136 | B2 | 11/2013 | Ertas et al. |

(Continued)

FOREIGN PATENT DOCUMENTS

| | | | |
|---|---|---|---|
| WO | 2007149866 | A2 | 12/2007 |

OTHER PUBLICATIONS

International Search Report and Written Opinion; PCT Application No. PCT/US2014/071023; dated Sep. 1, 2015.

(Continued)

*Primary Examiner* — Wei Wang
(74) *Attorney, Agent, or Firm* — Polsinelli PC

(57) ABSTRACT

A method of managing bottom hole assembly vibrations while drilling a wellbore including obtaining data regarding drilling parameters related to one or more drilling operations, determining if the bottom hole assembly has vibration levels outside of the range of normal operation parameters, modifying the drilling mud formulation to alter at least one of its physical properties and rheological properties to keep or maintain the vibration levels of the bottom hole assembly within the range of normal operation parameters, and mitigating the vibrations.

20 Claims, 6 Drawing Sheets

(56) References Cited

U.S. PATENT DOCUMENTS

| | | | | |
|---|---|---|---|---|
| 8,662,205 | B2 | 3/2014 | Wassell et al. | |
| 2007/0192071 | A1 | 8/2007 | Huang et al. | |
| 2009/0250264 | A1* | 10/2009 | Dupriest | E21B 7/00 175/40 |
| 2011/0077924 | A1 | 3/2011 | Ertas et al. | |
| 2012/0123757 | A1 | 5/2012 | Ertas et al. | |
| 2013/0092441 | A1 | 4/2013 | Hummes et al. | |
| 2014/0251688 | A1 | 9/2014 | Turner et al. | |
| 2016/0102236 | A1* | 4/2016 | Alwattari | C04B 28/02 166/278 |

OTHER PUBLICATIONS

Schlumberger, "Drillstring Vibrations and Vibration Modeling," http://www.slb.com/~/media/Files/drilling/brochures/drilling_opt/drillstring_vib_br.pdf.

Rajnauth, Jerome et al.; "Reduce Torsional Vibration and Improve Drilling Operations," International Journal of Applied Science and Technology; vol. 2, No. 7; Aug. 2012.

Lopez-Navarro, Eva M. et al.;. "Avoiding Harmful Oscillations in a Drillstring Through Dynamical Analysis," Journal of Sound and Vibration; 307 (2007); pp. 152-171.

Abstract of Sotomayor, Gabriel P.G. et al.; "Drill String Vibration: How to Identify and Suppress,"; Society of Petroleum Engineers; 1997.

Sugiura, Junichi et al.; "Real-Time Stick-Slip and Vibration Detection for 8 ½"-Hole-Size Rotary Steerable Tools in Deeper Wells and More Aggressive Drilling,"; American Association of Drilling Engineers; AADE-07-NTCE-47; 2007.

Office Action; Canadian Application No. 2,967,285; dated Feb. 14, 2019.

Larsen, Len Kyrvestad, Tools and Techniques to Minimize Shock and Vibration to the Bottom Hole Assembly, Master's Thesis, Spring 2014.

* cited by examiner

REAL TIME DRILLING FLUID RHEOLOGY MODIFICATION TO HELP MANAGE AND MINIMINZE DRILL STRING VIBRATIONS

CROSS-REFERENCE TO RELATED APPLICATIONS

This application is a national stage entry of PCT/US2014/071023 filed Dec. 18, 2014, said application is expressly incorporated herein in its entirety.

BACKGROUND

In hydrocarbon drilling operations, the drill bit and other components of the bottom hole assembly (BHA), including the drill string itself, are subjected to conditions which increase wear and degradation of these expensive components. One such condition is called "stick-slip," or torsional vibration of the BHA. Stick-slip is a downhole drilling dysfunction where low frequency torsional vibrations have increased because of improper BHA design, operating parameters, formation change or a combination of the above, the bit and BHA are experiencing increased friction and drag at the bit causing the bit to stop rotating. Once the bit has stopped rotating, torque may build up in the drillstring. The torque buildup causes the energy in the drillstring to increase until it overcomes the drag friction between the bit/BHA and the earthen formation, which frees the bit momentarily until the drag friction overcomes the rotational energy in the drillstring again. This causes a periodic motion called stick-slip.

Stick-slip is a contributing factor to excessive bit wear. Torsional vibration may have the effect that cutters on the drill bit may momentarily stop or be rotating backwards, i.e., in the reverse rotational direction to the normal forward direction of rotation of the drill bit during drilling. This is followed by a period of forward rotation of many times the rotation per minute (RPM) mean value. The effect of reverse rotation on a cutter element may be to impose unusual loads on the cutter, which tend to cause spalling or delamination of the polycrystalline diamond facing of a tungsten carbide cutter.

Additional types of vibration that may occur are axial and lateral. Axial vibrations are also known as bit bounce, and lateral vibrations are known as whirl of the bit or the bottom hole assembly (BHA).

Traditional methods of controlling vibrations include varying operational parameters such as weight-on-bit and RPM. However, these parameters have their limits as to vibration control and additional methods of mitigating drill string vibrations are needed.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to one having ordinary skill in the art and having the benefit of this disclosure.

DETAILED DESCRIPTION

Figure 1:
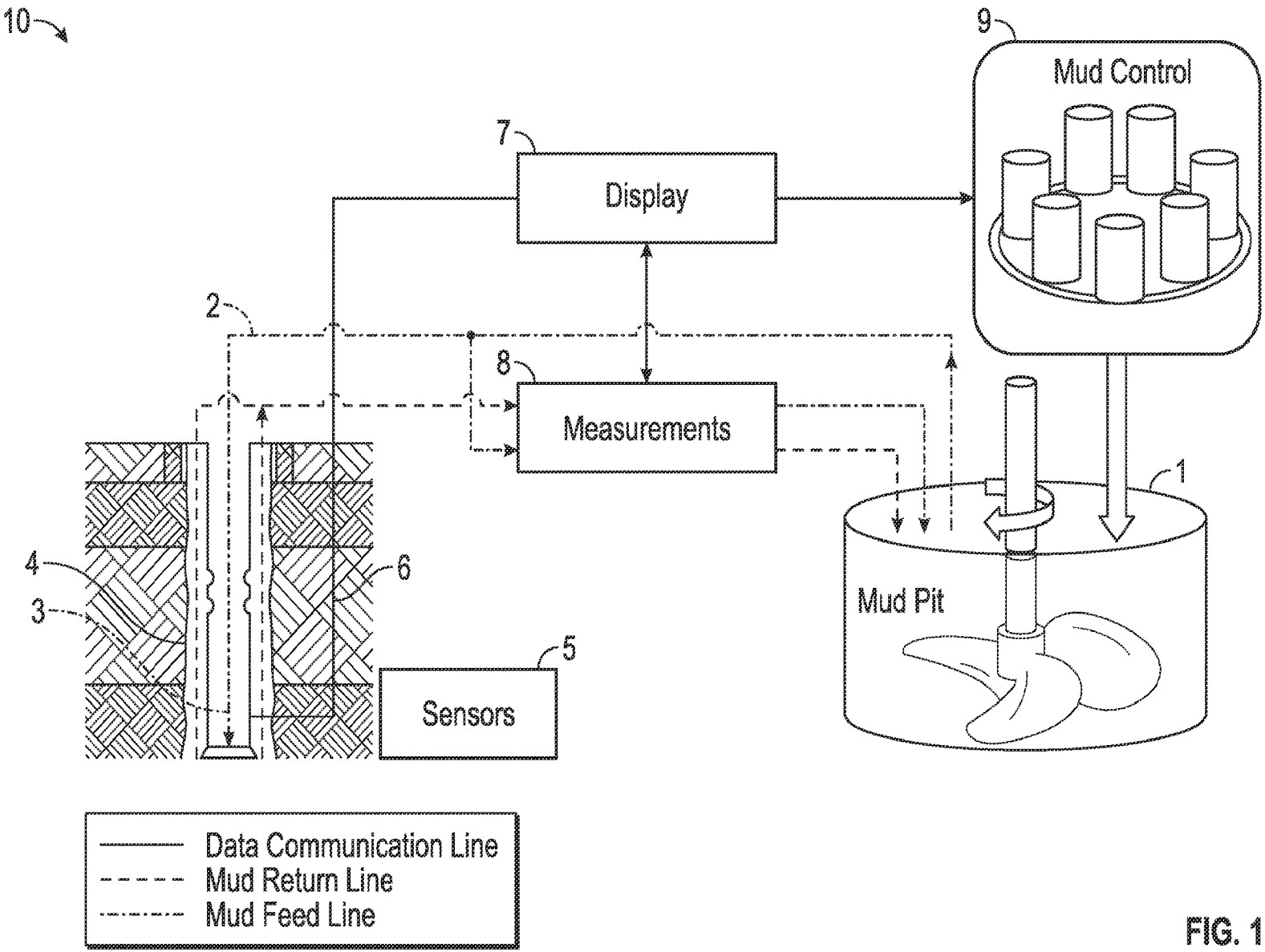
FIG. 1 is a schematic representation of the control system according to embodiments of the disclosure.

The present invention relates to optimizing drilling processes. In particular, the invention relates to controlling the properties of drilling fluids during dynamic drilling dysfunctions such as whirl, slick-slip and bit bounce.

One embodiment of the disclosure is directed to a method of managing bottom hole assembly vibrations while drilling a wellbore, the method comprising: obtaining data regarding drilling parameters related to one or more drilling operations, including parameters related to the bottom hole assembly and drilling mud; determining if the bottom hole assembly has vibrations outside of the range of normal operation parameters; modifying the drilling mud formulation to alter at least one of its physical properties, rheological properties, and combinations thereof to keep the vibrations of the bottom hole assembly within the range of normal operation parameters; and mitigating the vibrations. The mitigating may include at least one of damping of the vibrations or increased attenuation of the vibrations due to the modifying of the drilling mud formulation, and combinations thereof. The modifying of the drilling mud formulation may include changes to at least one of mud weight; mud type; viscosity; viscoelastic parameters; lubricity; and combinations thereof. The viscoelastic parameters may include at least one of a complex sheer modulus $G^*$; a storage modulus $G'$; a loss modulus $G''$; a real portion of viscosity $\eta'$; an imaginary portion of viscosity $\eta''$; a phase shift angle $\delta$; a loss factor $\tan(\delta)$; and combinations thereof. Data regarding drilling parameters may include at least one of drill bit rotary speed; bottom hole assembly rotary speed; bit depth; weight of bit; bottom hole assembly vibrations; mud pump speed; mud flow rate; mud viscosity; rate of penetration; mechanical specific energy; well trajectory; and combinations thereof. The modifying of the drilling mud formulation may include changes to at least one of mud weight; mud type; viscosity; formulation components, and combinations thereof. The bottom hole assembly vibrations may be at least one of torsionally induced; axially induced; laterally induced; and combinations thereof (otherwise known as coupled vibrations). The method may further comprise changing at least one of drill bit rotary speed; bottom hole assembly, rotary speed; bit depth; weight of bit; mud pump speed; mud flow rate; mud viscosity; rate of penetration; mechanical specific energy; well trajectory; stabilizer placement; and combinations thereof. The obtaining, determining, modifying, and mitigating may occur in real-time. In a planning mode it may comprise changing well placement, mud weight, fluid composition, trajectory, tubular selection, casing point selection, and combinations thereof.

Another embodiment of the disclosure is directed to a method of drilling a wellbore, the method comprising: drilling a wellbore using a bottom hole assembly and drilling mud; obtaining data regarding drilling parameters related to one or more drilling operations, including parameters related to the bottom hole assembly and drilling mud; determining if the bottom hole assembly has vibrations outside of the range of normal operation parameters; modifying the drilling mud formulation to alter at least one of its physical properties, rheological properties, and combinations thereof to keep the vibrations of the bottom hole assembly within the range of normal operation parameters; and mitigating the vibrations.

An embodiment of the disclosure is directed to a vibration managing system for a bottom hole assembly while drilling a wellbore, the vibration managing system comprising: a data collection device for collecting drilling parameter information related to one or more drilling operations, including parameters related to the bottom hole assembly and drilling mud; and a mud control system, wherein said vibration managing system: determines if the bottom hole assembly has vibrations outside of the range of normal operation parameters based on the data collected; modifies the drilling mud formulation by using the mud control system to alter at least one of the mud's physical properties, rheological properties, and combinations thereof to keep the vibrations of the bottom hole assembly within the range of normal operation parameters; and mitigates the vibrations.

As shown in FIG. 1, an exemplary vibration managing system 10 for a bottom hole assembly while drilling a wellbore 3 includes a mud pit 1, mud feed line 2, mud return line 4, and vibration sensors 5. Drilling operational parameters from downhole may be sent on data communication line 16 to a computer/display 7. This computer 7 may also communicate with drilling fluid measurements 8 taken at the surface. The computer 7 then relays instructions to the mud control system 9. The mud control system 9 may then change the properties of the mud that flows to the mud pit 1.

Figure 2:
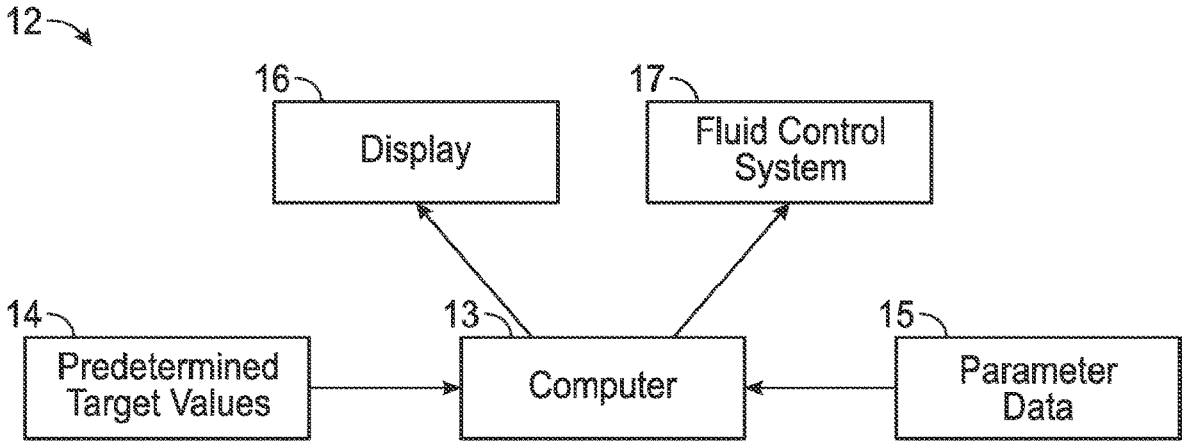
FIG. 2 is a schematic representation of the computer control system according to embodiments of the disclosure.

Referring to FIG. 2, a computer controlling system 12 may include a computer 13, a display 16, target parameter module 14, data input module 15, predetermined and a link to the fluids control module 17. Drilling operational parameter data 15 enters the computer 13 and is compared to predetermined target parameters 14. The results may be displayed on display 16 and or may be transmitted to fluids control module 17 in the form of instructions for necessary corrective actions.

Figure 3:
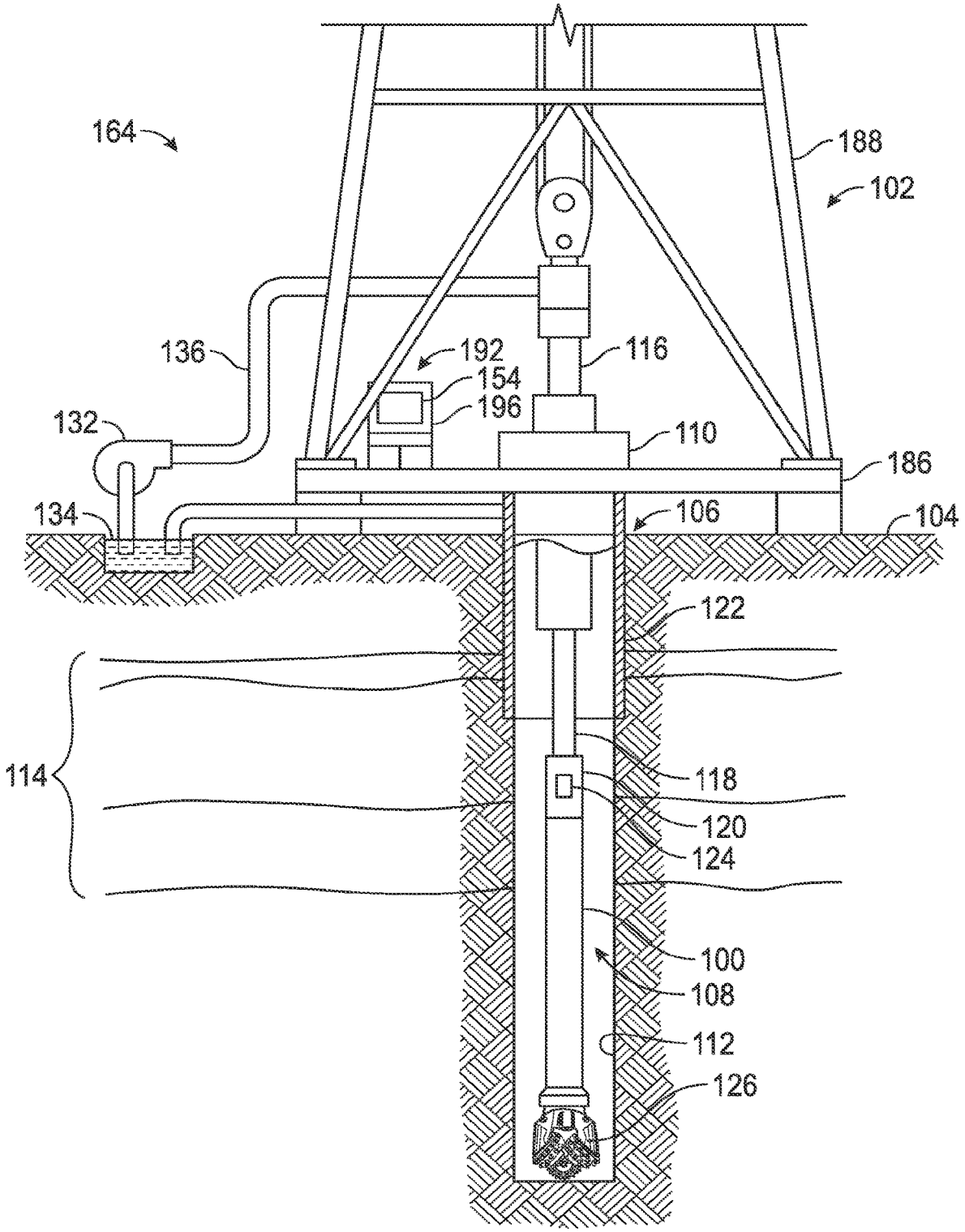
FIG. 3 illustrates a well during Measurement While Drilling (MWD) operations.

An example system operating environment for a vibration analysis system is described. FIG. 3 illustrates a well during Measurement While Drilling (MWD) operations; wherein the well 106 includes a drill string 108 having multiple sensors for detecting vibrations, according to some example embodiments described herein. It can be seen that surface system 164 includes a portion of a drilling rig 102 located at the surface 104 of the well 106. The drilling rig 102 provides support for the drill string 108. The drill string 108 can operate to penetrate a rotary table 110 used to rotate the drill string and to thus drill a borehole 112 through subsurface formations 114. The drill string 108 will often include a Kelly 116, drill pipe 118, and a bottom hole assembly 120 coupled at the lower portion of the drill pipe 118.

In some example embodiments, the bottom hole assembly 120 includes one or more drill collars 122, a downhole logging tool 124, and a drill bit 126. The drill bit 126 can operate to create a borehole 112 by penetrating the surface 104 and subsurface formations 114. The downhole tool 124 can comprise any of a number of different types of tools including MWD (measurement while drilling) tools, LWD tools, and others. In some example embodiments, the logging tool 124 will contain processing capability and circuitry for receiving measurements from the described sensors, and evaluating the measurements downhole. Where such downhole processing is performed, the results may be communicated to the surface through conventional data transmission systems known in the art, and the measurement data and the analysis thereof will, in some examples, also be retained in memory in the tool for later review, if needed. As further described below, in some example embodiments, different types of vibrational sensors are positioned at different locations along the drill string to determine a type of vibration mechanism (e.g., axial, torsional, lateral, etc.) and the location of the vibration (e.g., drill bit, bottom hole assembly, etc.).

As noted above, during drilling operations the drill string 108 (typically including the Kelly 116, the drill pipe 118, and the bottom hole assembly 120) can be rotated by the rotary table 110. In addition to, or alternatively, the bottom hole assembly 120, or some portion thereof, can also be rotated by a motor (e.g., a mud motor) that is located downhole. The drill collars 122 can be used to add weight to the drill bit 126. The drill collars 122 can also operate to stiffen the bottom hole assembly 120, allowing the bottom hole assembly 120 to transfer the added weight to the drill bit 126, and in turn, to assist the drill bit 126 in penetrating the surface 104 and subsurface formations 114.

During drilling operations, a mud pump 132 can pump drilling fluid (sometimes known by those of skill in the art as "drilling mud") from a mud pit 134 through a hose 136 into the drill pipe 118 and down to the drill bit 126. The drilling fluid flows out from the drill bit 126 and is returned to the surface 104 through an annular area 140 between the drill pipe 118 and the sides of the borehole 112. The drilling fluid is then returned to the mud pit 134, where such fluid is filtered. Typically, the drilling fluid is used to cool the drill bit 126, as well as to provide lubrication for the drill bit 126 during drilling operations. Additionally, the circulation of the drilling fluid is used to remove subsurface formation 114 cuttings created by operating the drill bit 126.

Detection of Vibrations

For purposes of illustration of the concepts herein, relative terms of "low," "medium" and "high" acceleration measurements are used herein. Such terms are not intended to reflect any specific values, as the quantitative measurements will be recognized to those skilled in the art to be variable depending on the drill string utilized and the components therein (for example, the sensors used, and the systems used in the drill string to mitigate transfer of shock and vibration through the drill string). For example, in terms of actual forces experienced, in many operational situations, with smooth drilling, the axial acceleration on the drill string is generally on the order of 1 g; but it can exceed 50 g force for short time intervals (for example, when using jars) or in rough drilling conditions; and the lateral shock can exceed 100 g in rough drilling conditions. Hence, in absolute forces, low vibration might be characterized, for example, by a mean vibration axial vibration level less than about 0.5 g with peaks on the order of 1 g for a few ms, and cross-axial vibration less than about 1 g with peaks no larger than 5 g. Similarly, high vibration might be characterized, for example, as a vibration in which either the axial vibration exceeds 1 g on average, it has peak accelerations exceeding 50 g, (for example, for 1 or more times per second), or the lateral vibration exceeds 10 g on average or the lateral vibration has peaks exceeding a few hundred g one or more times per second. Medium level vibration could then, in this example, be characterized by anything between those two states. Another way of quantifying the vibration level is to look at g RMS (root mean square) numbers, as they better depict the energy content of that particular dysfunction. One can set thresholds of 1, 3 and 5 g RMS for levels of lateral vibration, and other levels for torsional or axial vibration as they have a different impact on downhole tools. For clarity, however, the above examples are only examples, and are representative only of absolute forces; and thus actual measured vibration forces in any tool string may be substantially different from the example values, depending on the measurement system and the drill string characteristics, as discussed above.

As noted above, the measured axial, torsional, and/or lateral vibrations can determine different conditions downhole relative to the drill string operation. For example, an axial motion of a given magnitude can be indicative of bit bounce of the drill bit. Large weight on bit fluctuations can cause the drill bit to repeatedly lift-off and then impact the formation. For bit bounce, the indicative responses of the vibrational include high peak acceleration in the Z direction from both sensors. When comparison of the vibrational sensor measurements from both sensors indicates high peak acceleration along the Z axis, and thus indicates a bit bounce operational mode, the driller may than use that determination to change one or more drilling parameters (such a weight on bit, speed of rotation, etc.) to correct the undesired operational mode.

Another downhole drilling dysfunction of concern is "stick slip." Stick slip is a non-uniform (erratic) drill bit rotation in which the drill bit stops (or sticks to the borehole wall) rotating momentarily at regular intervals causing the drill sting to periodically torque up (slipping) and then spin free. When stick slip occurs, the average RPM signal may be generally uniform, but the instantaneous RPM signal may range from nearly 0 RPM to several multiples of the average RPM signal. A torsional motion of a given magnitude can be indicative of stick slip; and thus can be identified by comparison of the acceleration measurements from the spaced sensors. As a result of the motion characteristics during conditions of stick slip, indicative measurements of the vibrational sensors can include low to medium peak X and Y accelerations. For example, the above-described changes in instantaneous RPM will often reflected in an "extremely small" measured acceleration for some significant period of time (such as over the time period of a few revolutions), followed by a significantly increased measured acceleration as the string breaks free. The relative values of these acceleration measurements can be established relative to any desired reference, for example, the standard deviation typical of a drilling operation, as represented (by way of example only): by stand-alone calibrations of the sensors; by empirical or historical reference data (which in some cases may be tailored to specific drill string configurations or types of configurations); or by calibration measurements taken with the drill string in question, as just three examples. As another example, the measured acceleration measurements may be compared to reference measurements from vibrational sensors in the drill string at a location where sticking would not be expected, such as the portion of the well above the bottom hole assembly. When these values are evaluated relative to such reference values (such as observed outputs of the same or comparable X- and Y-sensors under known normal drilling conditions), then comparison to the known reference can be according to any desired relation to the reference values. On desirable such relation is to the standard deviation of the reference measurement(s). For example, in an example comparison, "extremely small" might mean less than some fraction of the standard deviation of the reference (e.g., for example 0.25 standard deviations). Typically in evaluating stick slip, the condition of an "extremely small" measured acceleration measurement must prevail for a significant portion of the expected rotational period (as e.g., at least 0.25 of a rotational period). The above-referenced observation of "low to medium peak X and Y accelerations" results from the fact that when the bit breaks free, normal drilling takes place, and the heavy side slap observed in some of the other types of motion, such as in chaotic whirl, will not typically be observed with stick-slip. Additionally, the acceleration measurements from the spaced sensors will be compared to one another, and in cases where the sensors are sufficiently spaced as to not be uniformly impacted by the sticking forces, the acceleration measurements will often be of different frequency and phase. Again, and as with the undesired operational modes as described below, comparison of the sensor signals to each other, and preferably also to a reference, allows identification of the system operational mode in essentially real time, and facilitates the driller taking corrective action. In the case of a whirl condition, that corrective action will often include reducing the surface RPM of the drill string.

Another downhole drilling dysfunction of interest is drill bit whirl. Drill bit whirl includes an eccentric rotation of the bit about a point other than its geometric center, typically caused by the bit, improper weight on bit or by wellbore gearing. Bit whirl can induce high frequency lateral vibration of the bit and the drill string. Without the use of analytical techniques as described herein, bit whirl can be very difficult to detect at the surface by the drilling operators. Bit whirl can cause many forms of deleterious conditions, including bit cutter impact damage, over-gauge forming of the borehole, bottom hole assembly connection failures, and MWD component failures. For bit whirl, the indicative responses of the vibrational sensors can include high peak X and Y accelerations, while the average X and average Y accelerations are about equal. High peak X and Y accelerations may be indicative of bit whirl because the motion tends to cause the bit to slam against the borehole wall. The average acceleration, however, may not appear to be too high as the peak values are from impulsive events. No asymmetry is expected in the X- and Y-values over a period of a few seconds, and thus average X and average Y acceleration measurements that are about equal signifies that, other than the impulsive events, the performance appears to be normal drilling operations. Where one or both of the vibrational sensors 202, 204 includes a magnetometer or other rotationally sensitive device, chaotic drill bit whirl will be characterized by frequencies significantly above the measured rotational frequency. Additionally, the onset of such chaotic drill but whirl can be observed by the frequencies of the acceleration measurements tending to increase in a sequence of doubling, tripling, and doubling or tripling again, and ultimately reaching chaos. Comparison of the measurements from the two sensors further assists in evaluating the location of the whirl and thus the actual operational mode, for example, distinguishing between drill bit induced whirl and BHA induced whirl, as discussed below.

Another downhole condition of interest is Bottom Hole Assembly (BHA) whirl. BHA whirl typically includes the BHA gearing around the borehole and results in several lateral shocks between the bottom hole assembly and the well bore. BHA whirl can be a major cause of many drill string and MWD component failures. BHA whirl can occur while rotating/reaming off-bottom and can also be very difficult to detect at the surface. Bottom hole assembly whirl can cause different MWD component failures (e.g., motor, MWD tool, etc.), localized tool joint and/or stabilizer wear, washouts or twist-offs due to connection fatigue cracks, increased average torque, etc.

Lateral shocks can also occur during the drilling operation. Lateral shocks can be caused the bottom hole assembly moving sideways, or in some cases whirling forward and backwards randomly. Lateral shocks of the bottom hole assembly (BHA) can be induced either from drill bit whirl or from rotating an unbalanced drill string. Similar to whirl, without the use of example techniques as described herein, lateral shocks can be very difficult to detect at the surface. Such non-steady-state motion may often be recognized from data indicating medium or high peak lateral accelerations but low average accelerations of the vibration. Lateral shocks have also been linked to different MWD and downhole tool connection failures. Lateral shocks can cause different MWD component failures (e.g., motor, MWD tool, etc.), localized tool joint and/or stabilizer wear, washouts or twist-offs due to connection fatigue cracks, increased average torque, etc. For lateral shocks, the responses of the vibrational sensors can include medium to high peak X or Y accelerations. In some example embodiments, peak X and Y are about equal. In some situations, there are no dominant peaks in the frequency plots of the high frequency burst data. Lateral shock can be largely defined by medium to high peak accelerations on either axis. One indication of many forms of drill string resonant condition is repeated shocks in a given direction. The direction may not correspond to an X- or Y-axis acceleration, but rather the peak X- and Y-accelerations occur simultaneously or in very close time proximity to one another (such as, on the order of milliseconds) and have some generally fixed ratio, or remain within a fixed bound, with respect to each other. While the ratio relationship of the acceleration measurements may be defined by persons of skill in the art having the benefit of the present disclosure.

In some operations, there is a vibration modal coupling involving all three motions (axial, torsional, and lateral vibrations). Such coupling can create axial and torque oscillations and high lateral shocks of the BHA. Vibration modal coupling can cause various of the previously-described operational problems, including different MWD component failures (e.g., motor, MWD tool, etc.), bit cutter impact damage, collar and stabilizer wear, washouts or twist-offs due to connection fatigue cracks, etc. For vibration modal coupling, as with indication of lateral shock, the representative responses of the vibrational sensors can include high peak X, Y and Z accelerations, accompanied by low to medium average X and Y accelerations. In many cases of such modal vibration coupling, the above indicia will be accompanied by discernible frequency patterns in the measurements.

In some example embodiments, a processor unit within the downhole tool and/or at the surface receives the vibration measurements from the vibration sensors. The processor unit is configured to determine a type of vibrational mode, and thus a drill string condition, based on a comparison of the measurement at the first location to the measurement at the second location, and in many cases in further reference to a reference value, as discussed above. An amplitude-based evaluation will be adequate for some evaluations, and thus in some example embodiments, the frequency response is not required for the evaluation. For example, large amplitude vibrations are dangerous, whether they are random or have some well-defined frequency content. And thus the techniques described herein may be of substantial value in identifying some operational modes without substantial consideration of the frequency content of the measurements. However, for some operational modes, such as drill string resonance and bit whirl, better identification of the operational mode can be obtained through use of a combination of amplitude and frequency. That identification of the operational mode (i.e., the cause of the vibration), makes it possible for the driller to take appropriate actions to remove the cause, so as to return to "normal" drilling operation modes.

Corrective Actions

The fluids control module has many corrective actions that it may take to bring the drilling operational parameters within the range of acceptable values. These actions may include modifications to the mud formulation, changes to the operation parameters, or both. For example, if it is known that stick-slip is occurring in the BHA, it may be possible for the operator of the rotary drilling system, at the surface, to reduce or stop the vibration by modifying the drilling mud parameters, such as viscosity. The operator may also change the speed of rotation of the drill string (RPM) and/or the weight-on-bit (WOB).

Figure 4:
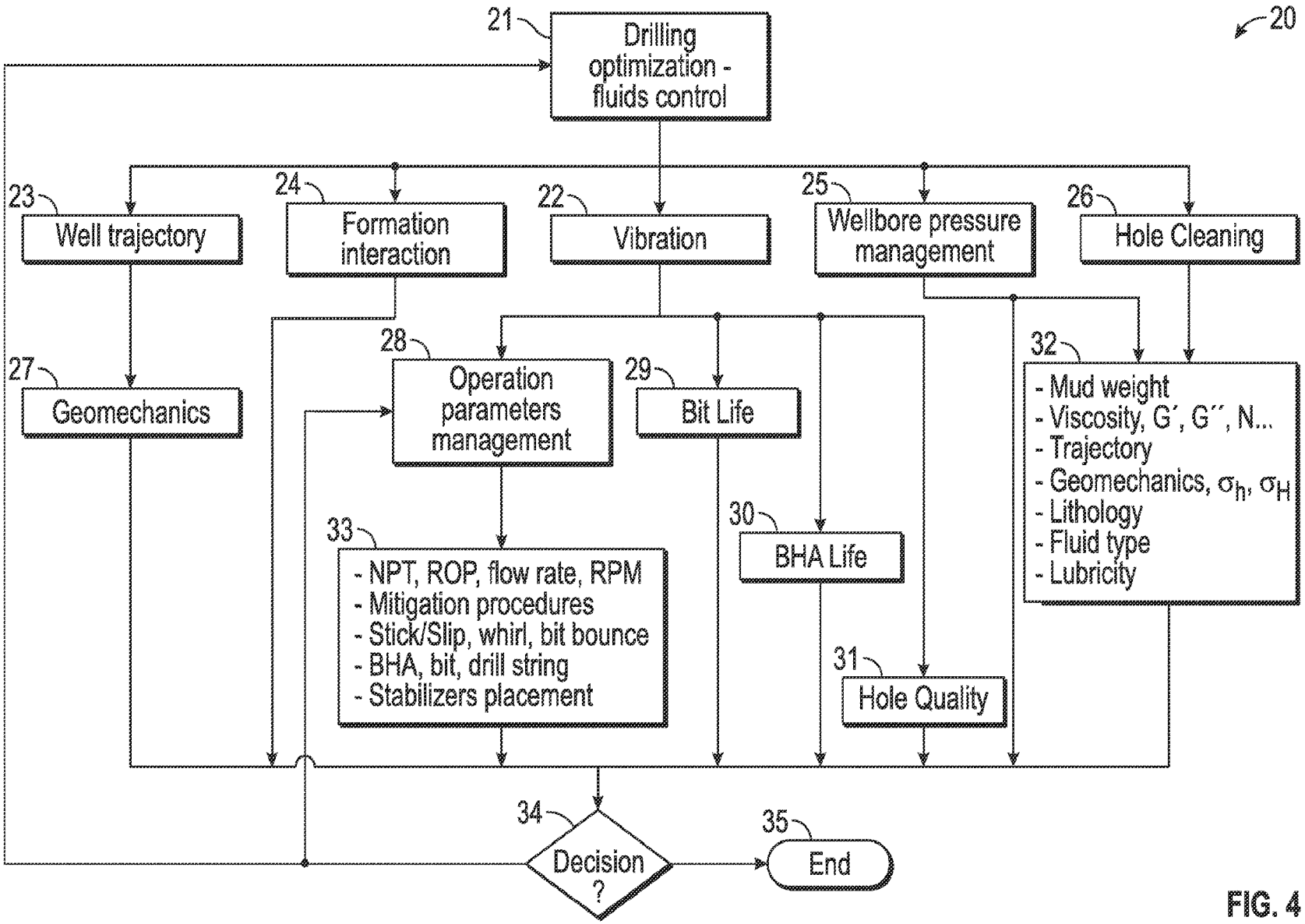
FIG. 4 is a flow diagram of the control system according to embodiments of the disclosure.

As illustrated in FIG. 4, one example of drilling optimization 20 using fluids control module 21 includes information about bottom hole tool vibrations 22, well trajectory 23, formation interaction 24, well pressure management 25, and hole cleaning 26. Fluids control module 21 may receive geomechanical information 27 before the information is sent to a decision module 34, where it is compared to predetermined target parameters. Vibration parameters 22 may affect operation parameters 28, bit life 29, BHA life 30, and hole quality 31. Wellbore pressure management parameters 25, may comprise those shown in box 32, including, mud weight, viscosity, trajectory, geomechanics, lithology, fluid types, and lubricity. Operation parameters 28 may comprise those shown in box 33, including NPT, ROP, flow rate, rpm, mitigation procedures, stick/slip, whirl, bit bounce, BHA, bit, drill string, and stabilizers placement. After the data parameters are sent to the decision box 34, the value is compared to a target value and if the value is within an acceptable range, the adjusting process is over 35. If the value is not within range, instructions are sent to the operation parameters management module 28, or the fluids control module 21.

Figure 5:
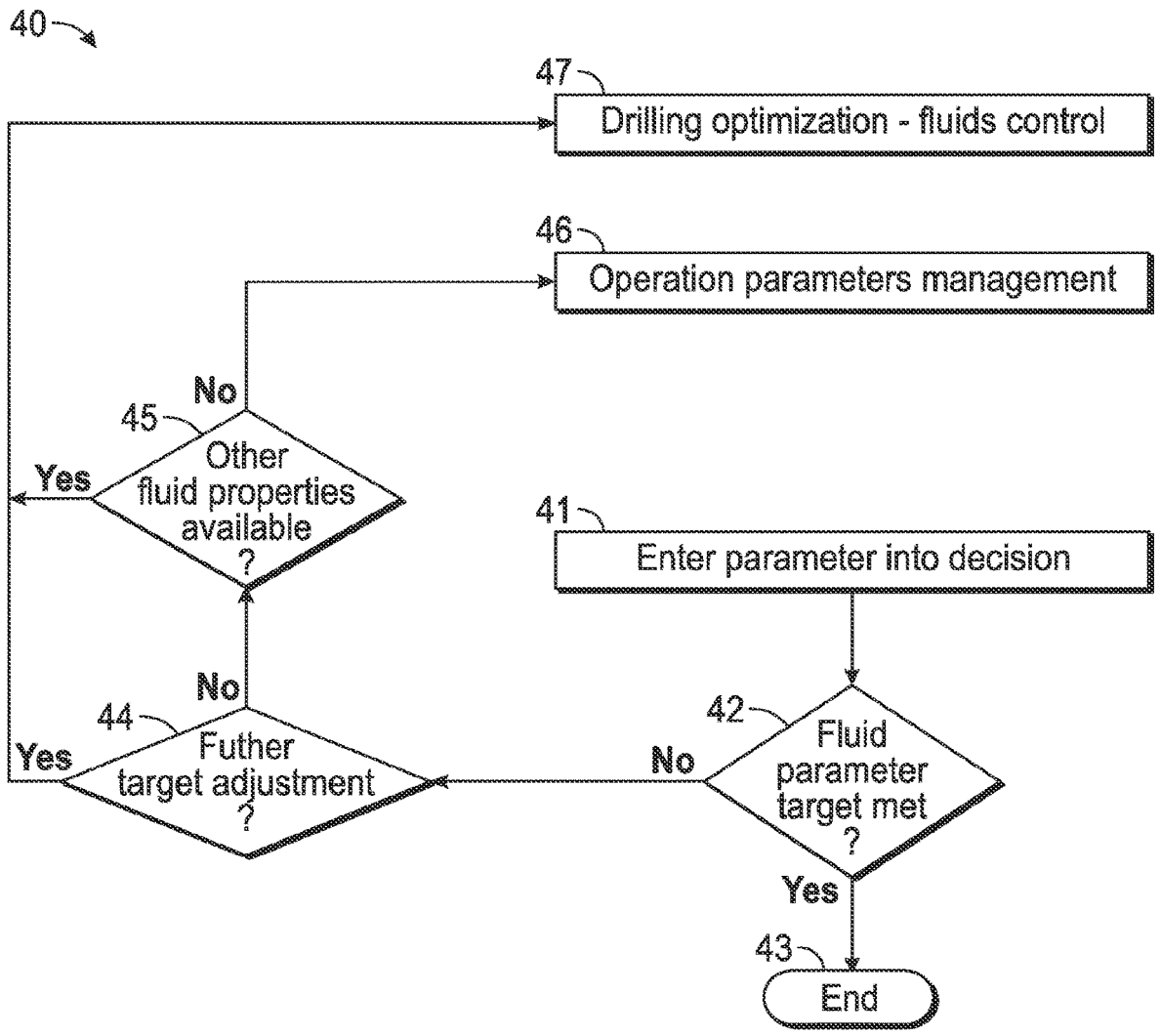
FIG. 5 is a flow diagram of the decision portion of the control system according to embodiments of the disclosure.

Now, referring to FIG. 5, an exemplary decision process 40 for fluid property parameters includes entering a parameter 41 into decision box 42. If the fluid property target is met, then the process is over 43. If the target is out of specification, then box 44 determines if the target can be further adjusted. If yes, then the parameter is sent back to the fluid control module 47 to go through the decision cycle again. If no further adjustments to the target value of the fluid parameter are possible, then the adjustment of other fluid properties is considered in box 45. If these may be adjusted, then instructions are sent to the fluids control module 47. If not, then the operation parameters management module 46 is notified and then non-fluid related parameters may be considered for adjustment. In a further embodiment, it is possible that other fluid properties may be available for adjustment 45 and that operational parameters 46 may also be simultaneously available. In this case, both fluid properties and operational parameters may be modified such that the vibrations affecting the downhole tool are mitigated.

Fluid Modifications

Numerous changes to the fluid properties may affect certain functions in the drilling process, and the chemical composition of the fluid/mud may affect all of the following properties. Density, free water capacity, and filtration parameters may affect wellbore wall support and stabilization. They may also contribute to at least one of balancing formation pressure, aiding in cuttings removal and solids control, cooling the drill bit, data transmission, hydraulic power, cleaning the bottom of the hole, and the transporting of cuttings to the surface, and combinations thereof.

Rheological fluid parameters such as viscosity and thixotropy may affect cooling the drill bit, data transmission, hydraulic power, cleaning the bottom of the hole, and the transporting of cuttings to the surface. Rheological fluid parameters may also contribute to at least one of borehole wall support and stabilization, balancing formation pressure, reducing friction and drag, and aiding in cuttings removal and solids control.

Modification of the lubricity coefficient may reduce friction, torque and drag. The solids content of the fluids may aid in cuttings removal and solids control. Solids content may also contribute to at least one of cooling the drill bit, data transmission, hydraulic power, cleaning the bottom of the hole, and the transporting of cuttings to the surface borehole wall support and stabilization, balancing formation pressure, and combinations thereof.

Changing one property of a fluid may change other properties. For example, changing the chemical composition may affect at least one of rheological parameters, density, filtration parameters, free water capacity, lubricity coefficients, and combinations thereof. Changing solids content may affect at least one of rheological parameters, lubricity coefficient, and combinations thereof.

In some embodiments, the mud may be modified with additives specifically designed to reduce vibrations including fibers, and larger particulates, and combinations thereof. In other embodiments, a specific cuttings load at the BHA may impact fluid rheology in a positive way for vibration management.

One of skill in the art will be familiar with how the modification of drilling fluid properties affects the functions in the drilling process.

Wellbore and Formation

Broadly, a zone refers to an interval of rock along a wellbore that is differentiated from surrounding rocks based on hydrocarbon content or other features, such as perforations or other fluid communication with the wellbore, faults, or fractures. As used herein, into a well means introduced at least into and through the wellhead. According to various techniques known in the art, equipment, tools, or well fluids can be directed from the wellhead into any desired portion of the wellbore. Additionally, a well fluid can be directed from a portion of the wellbore into the rock matrix of a zone.

Figure 6:
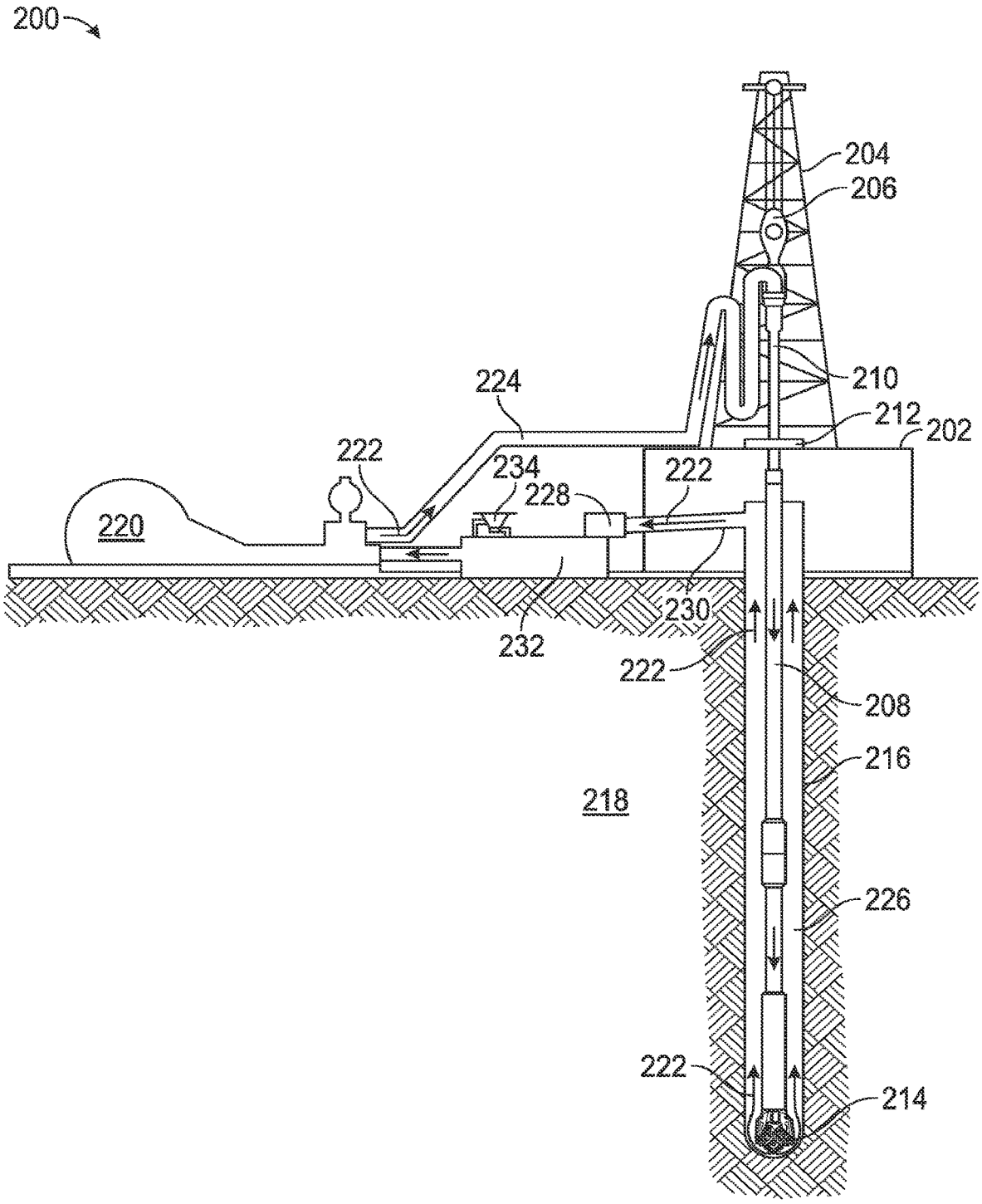
FIG. 6 depicts an embodiment of a system configured for drilling a well.

The exemplary methods disclosed herein may directly or indirectly affect one or more components or pieces of equipment associated with the preparation, delivery, recapture, recycling, reuse, and/or disposal of the disclosed cement compositions. For example, and with reference to FIG. 6, the disclosed methods may directly or indirectly affect one or more components or pieces of equipment associated with an exemplary wellbore drilling assembly 100, according to one or more embodiments. It should be noted that while FIG. 6 generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling assembly 200 may include a drilling platform 202 that supports a derrick 204 having a traveling block 206 for raising and lowering a drill string 208. The drill string 208 may include, but is not limited to, drill pipe and coiled tubing, as generally known to those skilled in the art. A kelly 210 supports the drill string 208 as it is lowered through a rotary table 212. A drill bit 214 is attached to the lower end of the drill string 208 and is driven either by a downhole motor and/or via rotation of the drill string 208 from the well surface (via top drive or rotary table). As the bit 214 rotates, it creates a borehole 216 that penetrates various subterranean formations 218.

A pump 220 (e.g., a mud pump) circulates drilling fluid 222 through a feed pipe 224 and to the kelly 210, which conveys the drilling fluid 222 downhole through the interior of the drill string 208 and through one or more orifices in the drill bit 214. The drilling fluid 222 is then circulated back to the surface via an annulus 226 defined between the drill string 208 and the walls of the borehole 216. At the surface, the recirculated or used drilling fluid 222 exits the annulus 226 and may be conveyed to one or more fluid processing unit(s) 228 via an interconnecting flow line 230. After passing through the fluid processing unit(s) 228, a "cleaned" or filtered drilling fluid 222 is deposited into a nearby retention pit 232 (i.e., a mud pit). While illustrated as being arranged at the outlet of the wellbore 216 via the annulus 226, those skilled in the art will readily appreciate that the fluid processing unit(s) 2128 may be arranged at any other location in the drilling assembly 200 to facilitate its proper function, without departing from the scope of the scope of the disclosure.

One or more of the disclosed methods may be used to modify the drilling fluid 222 via a mixing hopper 234 communicably coupled to or otherwise in fluid communication with the retention pit 232. The mixing hopper 234 may include, but is not limited to, mixers and related mixing equipment known to those skilled in the art. In other embodiments, however, the disclosed methods may be used to modify the drilling fluid 222 at any other location in the drilling assembly 200. In at least one embodiment, for example, there could be more than one retention pit 232, such as multiple retention pits 232 in series. Moreover, the retention put 232 may be representative of one or more fluid storage facilities and/or units where the compositions may be stored, reconditioned, and/or regulated until added to the drilling fluid 222.

As mentioned above, the methods may directly or indirectly affect the components and equipment of the drilling assembly 200. For example, the disclosed methods may directly or indirectly affect the fluid processing unit(s) 228 which may include, but is not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, any fluid reclamation equipment. The fluid processing unit(s) 228 may further include one or more sensors, gauges, pumps, compressors, and the like used store, monitor, regulate, and/or recondition the exemplary cement compositions.

The disclosed methods may directly or indirectly affect the pump 220, which representatively includes any conduits, pipelines, trucks, tubulars, and/or pipes used to fluidically convey the fluid compositions downhole, any pumps, compressors, or motors (e.g., topside or downhole) used to drive compositions into motion, any valves or related joints used to regulate the pressure or flow rate of the cement compositions, and any sensors (i.e., pressure, temperature, flow rate, etc.), gauges, and/or combinations thereof, and the like. The disclosed methods also directly or indirectly affect the mixing hopper 234 and the retention pit 232 and their assorted variations.

The disclosed methods may also directly or indirectly affect the various downhole equipment and tools that may come into contact with the compositions such as, but not limited to, the drill string 208, any floats, drill collars, mud motors, downhole motors and/or pumps associated with the drill string 208, and any MWD/LWD tools and related telemetry equipment, sensors or distributed sensors associated with the drill string 208. The disclosed methods may also directly or indirectly affect any downhole heat exchangers, valves and corresponding actuation devices, tool seals, packers and other wellbore isolation devices or components, and the like associated with the wellbore 216. The disclosed methods may also directly or indirectly affect the drill bit 214, which may include, but is not limited to, roller cone bits, PDC bits, hybrid bits, natural diamond bits, impregnated bits, any hole openers, reamers, coring bits, etc.

While not specifically illustrated herein, the disclosed methods may also directly or indirectly affect any transport or delivery equipment used to convey the compositions to the drilling assembly 200 such as, for example, any transport vessels, conduits, pipelines, trucks, tubulars, and/or pipes used to fluidically move the compositions from one location to another, any pumps, compressors, or motors used to drive the cement compositions into motion, any valves or related joints used to regulate the pressure or flow rate of the compositions, and any sensors (i.e., pressure and temperature), gauges, and/or combinations thereof, and the like.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Embodiments disclosed herein include:

A: A method of managing bottom hole assembly vibrations while drilling a wellbore, the method comprising: obtaining data regarding drilling parameters related to one or more drilling operations, including parameters related to the bottom hole assembly and drilling mud; determining if the bottom hole assembly has vibrations outside of the range of normal operation parameters; modifying the drilling mud formulation to alter at least one of its physical properties, rheological properties, and combinations thereof to keep the vibrations of the bottom hole assembly within the range of normal operation parameters; and mitigating the vibrations.

B: A method of drilling a wellbore, the method comprising: drilling a wellbore using a bottom hole assembly and drilling mud; obtaining data regarding drilling parameters related to one or more drilling operations, including parameters related to the bottom hole assembly and drilling mud; determining if the bottom hole assembly has vibrations outside of the range of normal operation parameters; modifying the drilling mud formulation to alter at least one of its physical properties, rheological properties, and combinations thereof to keep the vibrations of the bottom hole assembly within the range of normal operation parameters; and mitigating the vibrations.

C: A vibration managing system for a bottom hole assembly while drilling a wellbore, the vibration managing system comprising: a data collection device for collecting drilling parameter information related to one or more drilling operations, including parameters related to the bottom hole assembly and drilling mud; and a mud control system, wherein said vibration managing system: determines if the bottom hole assembly has vibrations outside of the range of normal operation parameters based on the data collected; modifies the drilling mud formulation by using the mud control system to alter at least one of the mud's physical properties, rheological properties, and combinations thereof to keep the vibrations of the bottom hole assembly within the range of normal operation parameters; and mitigates the vibrations.

Each of embodiments A, B and C may have one or more of the following additional elements in any combination: Element 1: wherein the mitigating includes at least one of damping of the vibrations or increased attenuation of the vibrations due to the modifying of the drilling mud formulation, and combinations thereof. Element 2: wherein the modifying of the drilling mud formulation includes changes to at least one of mud weight; mud type; viscosity; viscoelastic parameters; lubricity; formulation components and combinations thereof. Element 3: wherein the viscoelastic parameters include at least one of a complex sheer modulus $G^*$; a storage modulus $G'$; a loss modulus $G''$; a real portion of viscosity $\eta'$; an imaginary portion of viscosity $\eta''$; a phase shift angle $\delta$; a loss factor $\tan(\delta)$; normal stress and combinations thereof. Element 4: wherein data regarding drilling parameters includes at least one of drill bit rotary speed; bottom hole assembly rotary speed; bit depth; weight of bit; bottom hole assembly vibrations; mud pump speed; mud flow rate; mud viscosity; rate of penetration; mechanical specific energy; well trajectory; and combinations thereof. Element 5: wherein the modifying of the drilling mud formulation includes changes to at least one of mud weight; mud type; viscosity; and combinations thereof. Element 6: wherein the bottom hole assembly vibrations are at least one of torsionally induced; axially induced; laterally induced; and combinations thereof. Element 7: further comprising changing at least one of drill bit rotary speed; bottom hole assembly rotary speed; bit depth; weight of bit; mud pump speed; mud flow rate; mud viscosity, mud components; rate of penetration; mechanical specific energy; well trajectory; stabilizer placement; and combinations thereof. Element 8: wherein the obtaining, determining, modifying, and mitigating occur in real-time. Element 9: wherein the mud is modified with additives specifically designed to reduce vibration including at least one of fibers, larger particulates, and combinations thereof. Element 10: wherein a specific cuttings load at the BHA impacts fluid rheology in a positive way for vibration management.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

The invention claimed is:

1. A method managing bottom hole assembly vibrations while drilling a wellbore, the method comprising:

obtaining data regarding drilling parameters related to one or more drilling operations, including parameters related to the bottom hole assembly and drilling mud;

determining if the bottom hole assembly has vibration levels outside of a predetermined range of normal operation parameters;

adjusting, iteratively in real time, the drilling mud formulation to alter at least one of its physical properties, rheological properties, and combinations thereof; and mitigating the vibrations to keep the vibrations of the bottom hole assembly within the predetermined range of normal operation parameters by implementing an adjusted drilling mud formulation with the one or more drilling operations.

2. The method of claim 1, wherein the mitigating includes at least one of damping of the vibrations or increased attenuation of the vibrations due to the modifying of the drilling mud formulation, and combinations thereof.

3. The method of claim 1, wherein the modifying of the drilling mud formulation includes changes to at least one of mud weight; mud type; viscosity; viscoelastic parameters; lubricity; formulation components and combinations thereof.

4. The method of claim 3, wherein the viscoelastic parameters include at least one of a complex sheer modulus G*; a storage modulus G'; a loss modulus G"; a real portion of viscosity η'; an imaginary portion of viscosity η"; a phase shift angle δ; a loss factor tan(δ); normal stress and combinations thereof.

5. The method of claim 3, wherein the modifying of the drilling mud formulation includes changes to at least one of mud weight; mud type; viscosity; and combinations thereof.

6. The method of claim 3, wherein the modifying of the drilling mud formulation is modified with additives including at least one of fibers and/or larger particulates.

7. The method of claim 1, wherein data regarding drilling parameters includes at least one of drill bit rotary speed; bottom hole assembly rotary speed; bit depth; weight of bit; bottom hole assembly vibrations; mud pump speed; mud flow rate; mud viscosity; rate of penetration; mechanical specific energy; well trajectory; and combinations thereof.

8. The method of claim 7, wherein the bottom hole assembly vibrations are at least one of torsionally induced; axially induced; laterally induced; and combinations thereof.

9. The method of claim 1, further comprising changing at least one of drill bit rotary speed; bottom hole assembly rotary speed; bit depth; weight of bit; mud pump speed; mud flow rate; mud viscosity, mud components; rate of penetration; mechanical specific energy; well trajectory; stabilizer placement; and combinations thereof.

10. A method of drilling a wellbore, the method comprising:

drilling a wellbore using a bottom hole assembly and drilling mud;

obtaining data regarding drilling parameters related to one or more drilling operations, including parameters related to the bottom hole assembly and drilling mud;

determining if the bottom hole assembly has vibration levels outside of a predetermined range of normal operation parameters;

adjusting, iteratively in real time, the drilling mud formulation to alter at least one of its physical properties, rheological properties, mud components and combinations thereof; and mitigating the vibrations to keep the vibrations of the bottom hole assembly within the predetermined range of normal operation parameters by implementing an adjusted drilling mud formulation with the one or more drilling operations.

11. The method of claim 10, wherein the mitigating includes at least one of damping of the vibrations or increased attenuation of the vibrations due to the modifying of the drilling mud formulation, and combinations thereof.

12. The method of claim 10, wherein the modifying of the drilling mud formulation includes changes to at least one of mud weight; mud type; viscosity; viscoelastic parameters; lubricity; and combinations thereof.

13. The method of claim 12, wherein the viscoelastic parameters include at least one of a complex sheer modulus G*; a storage modulus G'; a loss modulus G"; a real portion of viscosity η'; an imaginary portion of viscosity η"; a phase shift angle δ; a loss factor tan(δ); normal stress and combinations thereof.

14. The method of claim 10, wherein data regarding drilling parameters includes at least one of drill bit rotary speed; bottom hole assembly rotary speed; bit depth; weight of bit; bottom hole assembly vibrations; mud pump speed; mud flow rate; mud viscosity; rate of penetration; mechanical specific energy; well trajectory; and combinations thereof.

15. The method of claim 10, further comprising changing at least one of drill bit rotary speed; bottom hole assembly rotary speed; bit depth; weight of bit; mud pump speed; mud flow rate; mud viscosity; rate of penetration; mechanical specific energy; well trajectory; stabilizer placement; and combinations thereof.

16. A vibration managing system for a bottom hole assembly while drilling a wellbore, the vibration managing system comprising:

a data collection device for collecting drilling parameter information related to one or more drilling operations, including parameters related to the bottom hole assembly and drilling mud; and a mud control system, wherein said vibration managing system:

determines if the bottom hole assembly has vibration levels outside of a predetermined range of normal operation parameters based on the data collected;

adjusts, iteratively in real time, the drilling mud formulation by using the mud control system to alter at least one of the mud's physical properties, rheological properties, and combinations thereof to keep the vibrations of the bottom hole assembly within the range of normal operation parameters; and mitigates the vibrations to keep the vibrations of the bottom hole assembly within the predetermined range of normal operation parameters by implementing an adjusted drilling mud formulation with the one or more drilling operations.

17. The system of claim 16, wherein the mitigating includes at least one of damping of the vibrations or increased attenuation of the vibrations due to the modifying of the drilling mud formulation, and combinations thereof.

18. The system of claim 16, wherein the modifying of the drilling mud formulation includes changes to at least one of mud weight; mud type; viscosity; viscoelastic parameters; lubricity; and combinations thereof.

19. The system of claim 18, wherein the viscoelastic parameters include at least one of a complex sheer modulus G*; a storage modulus G'; a loss modulus G"; a real portion of viscosity η'; an imaginary portion of viscosity η"; a phase shift angle δ; a loss factor tan(δ); and combinations thereof.

20. The system of claim 16, wherein data regarding drilling parameters includes at least one of drill bit rotary speed; bottom hole assembly rotary speed; bit depth; weight of bit; bottom hole assembly vibrations; mud pump speed; mud flow rate; mud viscosity; rate of penetration; mechanical specific energy; well trajectory; and combinations thereof.

* * * * *